US010632608B1

(12) United States Patent
Peeples, III

(10) Patent No.: US 10,632,608 B1
(45) Date of Patent: Apr. 28, 2020

(54) METHOD AND APPARATUS FOR HANGING A PICTURE

(71) Applicant: Lee R. Peeples, III, Biloxi, MS (US)

(72) Inventor: Lee R. Peeples, III, Biloxi, MS (US)

( * ) Notice: Subject to any disclaimer, the term of this patent is extended or adjusted under 35 U.S.C. 154(b) by 228 days.

(21) Appl. No.: 15/965,531

(22) Filed: Apr. 27, 2018

(51) Int. Cl.
*A47G 1/20* (2006.01)
*B25H 7/04* (2006.01)

(52) U.S. Cl.
CPC ..... *B25H 7/045* (2013.01); *A47G 1/205* (2013.01)

(58) Field of Classification Search
CPC ..... A47G 1/205; B25H 7/045
USPC ..... 33/574, 613, 645
See application file for complete search history.

(56) References Cited

U.S. PATENT DOCUMENTS 4,382,337 A * 5/1983 Bendick ..... B25H 7/04 33/574
5,867,917 A * 2/1999 Karon ..... A47G 1/205 33/613
6,000,142 A 12/1999 Deaton
6,026,584 A * 2/2000 Wegman ..... A47G 1/205 33/451
6,185,831 B1 * 2/2001 Pluciennik ..... A47G 1/205 33/613
6,574,880 B2 6/2003 Lombardo
7,234,245 B2 6/2007 Tatum
7,316,078 B2 * 1/2008 Hagman ..... A47G 1/205 248/544
7,350,312 B1 4/2008 Grillo
9,392,890 B1 7/2016 Royak
2002/0078582 A1 * 6/2002 Krake ..... A47G 1/205 33/613
2003/0051363 A1 * 3/2003 Hofmeister ..... A47G 1/205 33/613
2004/0098875 A1 * 5/2004 Gould ..... A47G 1/205 33/613
2006/0075650 A1 * 4/2006 Tatum ..... B25H 7/045 33/666
2007/0214669 A1 * 9/2007 Van Luchene ..... G01O 5/02 33/366.11
2007/0283588 A1 * 12/2007 Gardner ..... F16B 15/02 33/666
2008/0196262 A1 * 8/2008 Bommarito ..... A47G 1/205 33/613
2009/0064515 A1 * 3/2009 Parohl ..... A47G 1/16 33/365
2009/0313843 A1 * 12/2009 Compton ..... A47G 1/205 33/613
2010/0116964 A1 * 5/2010 Aleo ..... A47G 1/202 248/476
2011/0174953 A1 7/2011 Ruiz et al.
2012/0246957 A1 * 10/2012 Daniel ..... A47G 1/205 33/645

(Continued)

*Primary Examiner* — George B Bennett
(74) *Attorney, Agent, or Firm* — George L Williamson

(57) ABSTRACT

Method and apparatus to assist in hanging a picture frame on a wall. The apparatus comprises a marking member which is configured to pass through an aperture of a spring-loaded outer head of an enclosure when the outer head is pressed into the enclosure. The housing has an attachment member which is removably attachable thereto having an adhesive pad for attachment onto the area where the hook of the picture frame is disposed. After the attachment member is attached to the picture frame, the enclosure is attached to the attachment member.

20 Claims, 2 Drawing Sheets

(56) References Cited

U.S. PATENT DOCUMENTS

| | | | | |
|---|---|---|---|---|
| 2013/0318808 | A1* | 12/2013 | Howe | B25H 7/04 33/666 |
| 2013/0333233 | A1* | 12/2013 | Esposito | A47G 1/16 33/370 |
| 2016/0097625 | A1* | 4/2016 | Dykes | G01C 9/34 33/701 |
| 2017/0055732 | A1* | 3/2017 | Krake | A47G 1/205 |
| 2017/0079450 | A1 | 3/2017 | Russell | |
| 2018/0370017 | A1* | 12/2018 | Weitsman | B25H 7/045 |
| 2019/0070877 | A1* | 3/2019 | Flores | B41K 1/003 |
| 2019/0351541 | A1* | 11/2019 | Green | B25H 7/045 |

* cited by examiner

METHOD AND APPARATUS FOR HANGING A PICTURE

BACKGROUND OF THE INVENTION

Field of the Invention

The present invention relates generally to picture frames and, more particularly, is concerned with a method and apparatus for hanging a picture frame on a wall.

Description of the Related Art

Devices relevant to the present invention have been described in the related art, however, none of the related art devices disclose the unique features of the present invention.

In U.S. Pat. No. 7,234,245 dated Jun. 26, 2007, Tatum disclosed an attachment apparatus and methods for attaching picture frames to a wall. In U.S. Patent Application Publication No. 2011/0174953 dated Jul. 21, 2011, Ruiz, et al., disclosed a picture hanging marker for use with picture frames. In U.S. Pat. No. 9,392,890 dated Jul. 19, 2016, Royak disclosed a hanger and method for hanging a picture frame. In U.S. Pat. No. 7,350,312 dated Apr. 1, 2008, Grillo disclosed a device for mounting a picture frame on a wall. In U.S. Patent Application Publication No. 2017/0079450 dated Mar. 23, 2017, Russell disclosed an apparatus and method to facilitate hanging wall art. In U.S. Pat. No. 6,000,142 dated Dec. 14, 1999, Deaton disclosed a picture hanging locator device. In U.S. Pat. No. 4,382,337 dated May 10, 1983, Bendick disclosed a device for locating a suspension hook. In U.S. Pat. No. 6,574,880 dated Jun. 10, 2003, Lombardo disclosed a marker for indicating a site for a fastener. In U.S. Patent Application Publication No. 2004/0098875 dated May 27, 2004, Gould disclosed a picture placement apparatus.

While these devices may be suitable for the purposes for which they were designed, they would not be as suitable for the purposes of the present invention as hereinafter described. As will be shown by way of explanation and drawings, the present invention works in a novel manner and differently from the related art.

SUMMARY OF THE PRESENT INVENTION

The present invention discloses a method and apparatus to assist in hanging a picture frame on a wall. The apparatus comprises a marking member which is configured to pass through an aperture of a spring-loaded outer head of an enclosure when the outer head is pressed into the enclosure. The housing has an attachment member which is removably attachable thereto having an adhesive pad for attachment onto the area where the hook of the picture frame is disposed. After the attachment member is attached to the picture frame, the enclosure is attached to the attachment member.

An object of the present invention is to provide a simple and easy to use method for hanging a picture on a wall. A further object of the present invention is to provide a method for marking a wall for placement of nails or screws therein so that a picture frame can be easily hung on the wall. A further object of the present invention is to allow a user to easily and effectively mark a wall so that a picture frame can be positioned accurately on a wall. A further object of the present invention is to provide a means for marking a wall simply by holding a frame up to the wall and pushing the frame toward the wall. A further object of the present invention is to provide a device for hanging a picture on a wall which can be easily operated by a user. A further objective of the present invention is to provide a device which can be relatively easily and inexpensively manufactured.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
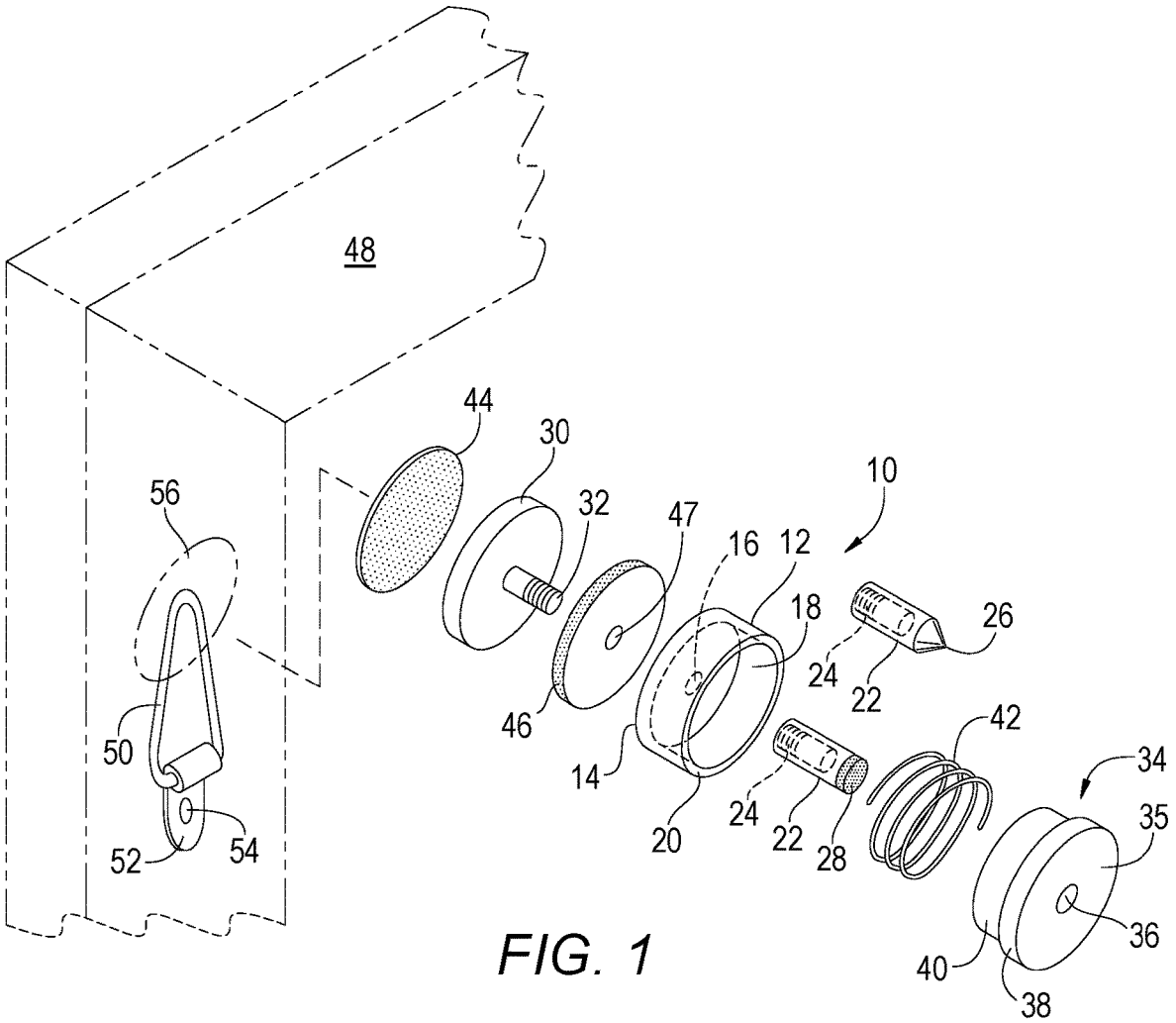
FIG. 1 is an exploded perspective view of one embodiment of the present invention.

With regard to reference numerals used, the following numbering is used throughout the drawings.

10 present invention
12 housing
14 base
16 aperture
18 interior space
20 outer rim
22 marking member
24 threaded recess
25 external threads
26 pointed tip
28 ink marker tip
30 attachment member
32 threaded screw
34 outer head
35 outer face
36 aperture
38 outer flange
40 insert portion
42 spring
44 adhesive pad
46 disk
47 aperture
48 picture frame
50 triangle hook
52 bracket

54 fastener
56 preferred target area
58 wall

DETAILED DESCRIPTION OF THE PREFERRED EMBODIMENT

The following discussion describes in detail at least one embodiment of the present invention. This discussion should not be construed, however, as limiting the present invention to the particular embodiments described herein since practitioners skilled in the art will recognize numerous other embodiments as well. For a definition of the complete scope of the invention the reader is directed to the appended claims. FIGS. 1 through 5 illustrate the present invention wherein a method and apparatus for hanging a picture on a wall is disclosed and which is generally indicated by reference number 10.

Turning to FIG. 1, therein is shown a first embodiment of the present invention 10 having a housing 12 being generally cylindrical and cup-like having a base 14 having an aperture 16 centrally located therein wherein the housing has an interior space 18 forming an outer rim 20. A marking member or pin 22 having a threaded recess on one end 24 and in one version having a pointed tip 26 and in another version having an ink marking tip 28 allowing the marking pen 22 to be centrally mounted within the housing 12 by having a disc-shaped base or attachment member 30 including a threaded screw 32 thereon which passes through aperture 16 for attachment of the marking pin 22. An outer head 34 with flat outer face 35 is shown also having a central aperture 36 therein and an outer flange 38 having a diameter greater than a smaller diameter telescoping or insert portion 40 for being telescoping or removably insertable within the interior space 18 of housing 12 and having a spring 42 for resiliently biasing outer head 34 away from housing 12. Also shown is an adhesive pad 44 for placement onto a surface of base or attachment member 30 and also a compliant foam or soft rubber disk 46 with central aperture 47 so that the present invention 10 can best seat the hook 50 without the present invention 10 or hook 50 wiggling around. Also shown is picture frame 48 having a triangle hook attachment member 50 attached to a rear side of the picture frame 48 using a bracket 52 and including a fastener 54 so that the bracket and hook can be attached to the rear side of the picture frame 48 in the conventional manner. Also shown is a preferred target area 56 shown in phantom line on a rear side of picture frame 48 which would be the desired location for attaching the adhesive pad 44 of the present invention 10 to the picture frame 48 so that the picture frame would be hung on a wall accurately and in the preferred location regarding height, width, vertical angle and, in general, the desired spatial relationship of the frame with the wall.

Figure 2:
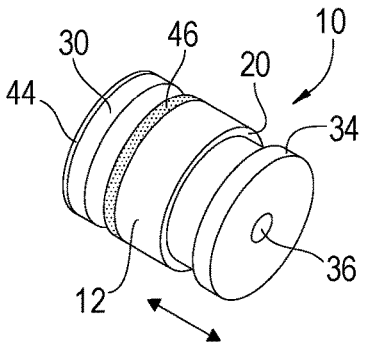
FIG. 2 is a perspective view of the present invention with the marking member retracted.

Turning to FIG. 2, therein is shown the present invention 10 with the housing 12 showing the outer head 34 and face 35 extended away from housing 12 along with the base or attachment member 30, the disk 46 and adhesive pad 44 with the outer head 34 extended away from base 12.

Figure 3:
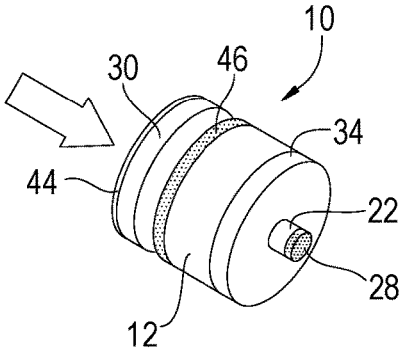
FIG. 3 is a perspective view of the present invention with the marking member extended.

Turning to FIG. 3, therein is shown the present invention 10 with the housing 12 showing the outer head 34 and face 35 retracted into housing 12 along with the base or attachment member 30, the disk 46 and adhesive pad 44 with the outer head 34 extended away from base 12 wherein the marking member 22 is shown extended through aperture 36 with the ink marker tip 28 in an extended position and exposed so that it can be used to place a mark upon a wall.

Figure 4:
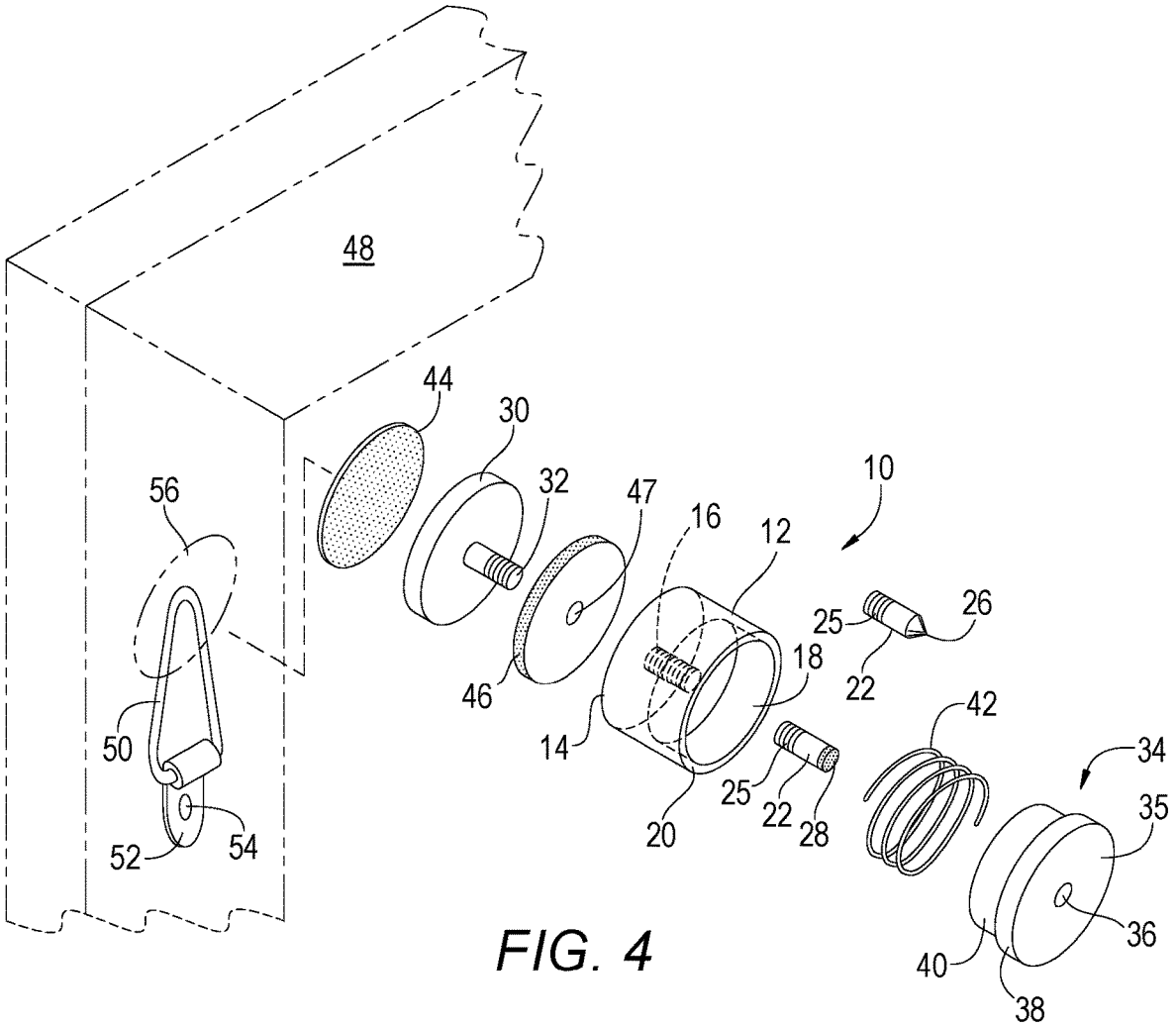
FIG. 4 is an exploded perspective view of a second embodiment of the present invention.
Figure 5:
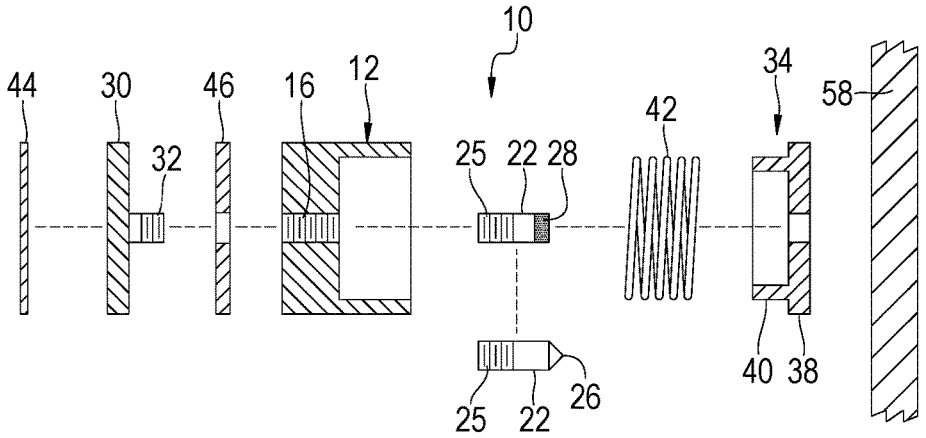
FIG. 5 is an exploded cross sectional view of a second embodiment of the present invention.

Turning to FIGS. 4 and 5, therein is shown a second embodiment of the present invention 10 which is similar to the first embodiment shown in FIG. 1 having a housing 12 having a base 14 having a female internal threaded aperture 16 centrally located therein wherein the housing has an interior space 18 with outer rim 20. A marking member or pin 22 with male external threads at 25 on one end and in one version having a pointed tip 26 and in another version having an ink marking tip 28 allowing the marking pen 22 to be centrally mounted within the housing 12 by having a disc-shaped base or attachment member 30 including a threaded screw 32 thereon which screws into aperture 16 from one direction while having marking member 22 screw into the threaded aperture 16 from the opposite direction. Otherwise embodiment two show in FIGS. 4 and 5 is similar to embodiment one shown in FIG. 1. Also shown is outer head 34 with flat face 35 and central aperture 36 therein and outer flange 38 and telescoping or insert portion 40 for being telescoping or removably insertable within the interior space 18 of housing 12 and having a spring 42 for resiliently biasing outer head 34 away from housing 12. Also shown is an adhesive pad 44 for placement onto a surface of base or attachment member 30 and also a compliant foam or soft rubber disk 46 and aperture 47 so that the present invention 10 can best seat the hook 50 without the present invention 10 or hook 50 wiggling around. Also shown in FIG. 4 is picture frame 48 having a triangle hook attachment member 50 attached to a rear side of the picture frame 48 using a bracket 52 and including a fastener 54 so that the bracket and hook can be attached to the rear side of the picture frame 48 in the conventional manner. Also shown is a preferred target area 56 shown in phantom line on a rear side of picture frame 48 which would be the desired location for attaching the adhesive pad 44 of the present invention 10 to the picture frame 48. A portion of a wall 58 is also shown in FIG. 5 having a surface be marked by the marking member 22 and upon which wall the picture frame 48 is to be hung.

The present invention 10 allows a user to easily mark a wall 58 and is ideal for frames 48 having popular triangle or "D" shaped hooks 50. The present invention 10 attaches to the hook 50 and allows the user to mark a wall 58 simply by holding the frame 48 up to the wall and pushing the frame toward the wall which allows the user to mark the wall for later placement of nails, screws or the like for hanging the picture frame or the like on the wall in the conventional manner.

In operation, initially the base or attachment member 30 with its adhesive pad 44 is unattached from the housing 12 and is placed onto the target area 56 of the picture frame 48 as illustrated in FIG. 1; the base using threaded screw 32 is then screwed into the base 14 of housing 12 so that the housing and outer head 34 are attached. The thin foam cushion or disc 46 assists with providing a snug fit around the picture frame hook 50. The enclosure or housing 12 is then placed on the threaded screw 32 as previously explained. Next, the frame 48 with present invention 10 and outer head 34 thereon, is held up to the wall 58 and then the frame 48 is pushed toward the wall so as to force the outer face 35 inwardly so that the marking number 22 puts a mark on an outer surface of the wall 58 wherein the ink marker tip 28 puts an ink mark on the wall and the pointed tip 26 puts a small divot in the surface of the wall.

I claim:

1. An apparatus for marking a wall to assist in hanging a picture frame on the wall, comprising:

a) an enclosure, said enclosure being cylindrically shaped having a side wall and a base and being open at the top, said enclosure having an interior space therein, said base of said enclosure having a centrally disposed aperture therein;

b) an outer head, said outer head being telescopically disposed in said enclosure, wherein said outer head is biased away from said enclosure;

c) a marking member, said marking member being removably disposed in said aperture of said enclosure; and, d) an attachment member, said attachment member being removably attachable to said base of said enclosure.

2. The apparatus of claim 1, further comprising a spring for biasing said outer head away from said base of said enclosure.

3. The apparatus of claim 2, wherein said marking member has a pointed tip on one end.

4. The apparatus of claim 3, wherein said marking member has an ink marker on said one end.

5. The apparatus of claim 4, further comprising an adhesive pad disposed on said attachment member.

6. The apparatus of claim 5, further comprising a threaded screw mounted on said attachment member so as to be insertable through said aperture of said enclosure.

7. The apparatus of claim 6, wherein said marking member has female threaded internal threads thereon for removable attachment to said threaded screw of said attachment member.

8. The apparatus of claim 7, wherein said base of said enclosure has internal female threads thereon for receiving said threaded screw of said attachment member.

9. The apparatus of claim 8, wherein said marking member has external male threads thereon for removable insertion into said aperture of said base of said enclosure.

10. The apparatus of claim 9, wherein said outer head telescopes inwardly in a first position and telescopes outwardly in a second position relative to said interior space of said enclosure, wherein said one end of said marking member protrudes through said aperture of said outer head when said outer head is in said first position.

11. The apparatus of claim 10, further comprising a flexible disk disposed between said base of said enclosure and said attachment member.

12. A method for marking a wall to assist in hanging a picture frame on the wall, comprising the steps of:

a) providing an enclosure being cylindrically shaped having a side wall and a base and being open at the top, the enclosure having an interior space therein, the base of the enclosure having a centrally disposed aperture therein;

b) providing an outer head being telescopically disposed in the enclosure and biasing the outer head away from the enclosure;

c) providing a marking member being removably disposed in the aperture of the enclosure; and d) removably attaching an attachment member to the base of the enclosure.

13. The method of claim 12, wherein the marking member has a pointed tip on one end.

14. The method of claim 13, wherein the marking member has an ink marker on the one end.

15. The method of claim 14, further comprising the step of providing an adhesive pad on the attachment member.

16. The method of claim 15, further comprising the step of providing a threaded screw mounted on the attachment member for insertion through the aperture of the enclosure.

17. The method of claim 16, wherein the marking member has female threaded internal threads thereon for removable attachment to the threaded screw of the attachment member.

18. The method of claim 17, wherein the base of the enclosure has internal female threads thereon for receiving the threaded screw of the attachment member.

19. The method of claim 18, wherein the marking member has external male threads thereon for removable insertion into the aperture of the base of the enclosure.

20. The method of claim 19, wherein the outer head telescopes inwardly in a first position and telescopes outwardly in a second position relative to the interior space of the enclosure, wherein the one end of the marking member protrudes through the aperture of the outer head when the outer head is in the first position.

* * * * *